US010226393B1

(12) United States Patent
Guillet

(10) Patent No.: US 10,226,393 B1
(45) Date of Patent: Mar. 12, 2019

(54) METHOD OF AND APPARATUS FOR ASSISTING PERSONS FROM A LYING POSITION TO A SITTING POSITION AND A SITTING POSITION TO A LYING POSITION

(71) Applicant: Lever Up, Inc., Palo Alto, CA (US)

(72) Inventor: Marc A. Guillet, Palo Alto, CA (US)

(73) Assignee: Lever Up, Inc., Palo Alto, CA (US)

( * ) Notice: Subject to any disclaimer, the term of this patent is extended or adjusted under 35 U.S.C. 154(b) by 599 days.

(21) Appl. No.: 14/919,647

(22) Filed: Oct. 21, 2015

Related U.S. Application Data

(60) Provisional application No. 62/067,880, filed on Oct. 23, 2014.

(51) Int. Cl.
*A61G 7/10* (2006.01)

(52) U.S. Cl.
CPC ..... *A61G 7/1038* (2013.01)

(58) Field of Classification Search
CPC ..... A61G 7/1038; A61G 7/103; A61G 7/1061
See application file for complete search history.

(56) References Cited

U.S. PATENT DOCUMENTS 2,404,734 A * 7/1946 Lenahan ..... A61G 7/1019 5/81.1 R
2,607,050 A * 8/1952 Binschoff ..... A61G 7/1017 5/628
3,512,189 A * 5/1970 Swanson ..... A61G 7/065 128/845
3,883,176 A * 5/1975 Morton ..... A47C 3/12 297/452.14
4,977,630 A * 12/1990 Oswalt ..... A61G 1/00 297/316
5,121,961 A * 6/1992 Marshall ..... A47C 1/143 297/17
5,916,085 A * 6/1999 Wells ..... A61G 7/053 5/608
6,185,761 B1 * 2/2001 Chapman ..... A61G 7/1011 5/81.1 HS
2007/0079440 A1 * 4/2007 De Kruijf ..... A61G 7/053 5/83.1
2009/0144894 A1 * 6/2009 Shiffert ..... A61G 7/1038 5/81.1 T
2009/0265853 A1 * 10/2009 Maxwell ..... A61G 7/1038 5/601
2015/0342811 A1 * 12/2015 Wong ..... A61G 7/1023 5/81.1 T
2016/0184151 A1 * 6/2016 Anderberg ..... A61F 5/37 5/648

* cited by examiner

*Primary Examiner* — Eric J Kurilla
(74) *Attorney, Agent, or Firm* — Haverstock & Owens LLP

(57) ABSTRACT

A method and apparatus for assisting persons from a lying position to a sitting position comprises a mechanical support support board for supporting a body of the person while lying in bed. An extension of the support board reaches away from the bed to accommodate the legs and thighs of the person. The support board is pivoted and tilted upwards in order to move the person from a lying position to an upright and sitting position. The support board assists caregivers with lifting a patient in and out of bed while minimizing both risk of injury to the caregiver and physical and emotional discomfort to the patient.

9 Claims, 10 Drawing Sheets

METHOD OF AND APPARATUS FOR ASSISTING PERSONS FROM A LYING POSITION TO A SITTING POSITION AND A SITTING POSITION TO A LYING POSITION

RELATED APPLICATIONS

This Patent Application claims priority under 35 U.S.C. 119(e) of the U.S. provisional patent application, Application No. 62/067,880, filed on Oct. 23, 2014, and entitled "METHOD AND APPARATUS FOR ASSISTING DISABLED PERSONS FROM SIDE-LYING TO SITTING", which is hereby incorporated in its entirety by reference.

FIELD OF THE INVENTION

This invention generally relates to medical devices and caregiving apparatuses. More particularly, this invention relates to a method and apparatus for assisting persons from a lying position to a sitting position and from a sitting position to a lying position.

BACKGROUND OF THE INVENTION

Lower back pain is one of the most debilitating and costly ailments in the United States. It is the single leading cause of disability worldwide with Americans spending nearly $50 billion dollars each year on back pain.

One common movement which leads to back pain is trying to lift something while bending forward and twisting. This common movement is one that caregivers must make everyday in order to assist patients while getting in and out of bed. This compromised position that caregivers must put themselves in can increase the load on their spine by 10-fold from the normal upright standing posture.

Currently, no device exists which simply reduces the strain and/or potential injury to caregivers when assisting patients moving from a supine position to a sitting position. Rather, caregivers are typically instructed in lifting strategies using their own bodies in order to minimize impact from the strain. However, such lifting strategies are not optimal for either the patient and the caregiver. The lifting position inherently places the the caregiver at risk for injury. Also, the patient may feel insecure, frightened, and may feel physical discomfort from being supported and pulled up by an aim of the caregiver reaching into an awkward position. Absent a solution, caregivers are prone to injury and may be less likely to engage in these maneuvers. Additionally, patient health may be adversely impacted because getting out of bed and moving are often critical factors in patient recovery.

SUMMARY OF THE INVENTION

A method of and apparatus for assisting persons from a lying position to a sitting position comprises a mechanical support support board for supporting a body of the person while lying in bed. An extension of the support board reaches away from the bed to accommodate the legs and of the person such that the patient's thighs can be supported substantially at 90° from the torso and the calves are substantially at 90° to the thighs. The patient's calves are supported by the extension completely off of the bed. The support board is pivoted and tilted upwards in order to move the person from a lying position to an upright and sitting position. The support board assists caregivers with lifting a patient in and out of bed while minimizing both risk of injury to the caregiver, physical stress to the patient and emotional discomfort of the patient. The motions can be reversed in order to assist the patient moving from the sitting position to the lying position.

In one aspect, a method of assisting a person moving into and out of a bed comprises aligning a support board with the bed, aligning the support board with the person's body and moving the support board and the person to an upright and sitting position. The support board is aligned so that an upper section of the board is on the bed and a lower section of the board extends from and off of the bed. In this disclosure, the upper portion of the support board refers to the portion of the board configured to support the patient's torso and hips. Likewise, the lower portion of the board refers to the portion of the board configured to support the patient's legs. Additionally, the support board is aligned so that the person's upper body is supported by an upper section of the support board and the person's lower body is supported by a lower section of the support board. In some embodiments, the support board is aligned so that the person's hip aligns in a direction with a marker made on the board. In some embodiments, the support board comprises one or more handles. In these embodiments, the support board can be moved to the upright and sitting position using the one or more handles. Particularly, the support board is configured to balance on the bed without the person's body weight while the lower portion of the support board is cantilevered off of the bed. In some embodiments, the support board comprises a rounded section which acts as a fulcrum when the board and the person are tilted to the upright and sitting position. In some embodiments, the support board comprises a foothold for providing greater leverage when tilting the board. In further embodiments, the support board removably couples to the bed. In still further embodiments, the support board comprises a roller base in order to transfer the support board between multiple beds. In some embodiments, the support board comprises a loadable torsion spring that is released to move the support board to the upright and sitting position In another aspect, an apparatus for supporting a person into and out of bed comprises a body comprising an upper section configured to support an upper body of the person and a lower section configured to support a lower body of the person, wherein the body is tilted downward from a sitting position to support the person into bed and the body is separately tilted upwards from a lying position to support the person out of bed. In some embodiments, the body comprises one or more handles. The body is configured to balance on the bed without the person's body weight. In some embodiments, the body comprises a rounded section which acts as a fulcrum when the board and the person are tilted to the upright and sitting position. In further embodiments, the apparatus comprises a foothold for providing greater leverage when tilting the body. In some embodiments, the body removably couples to the bed. In further embodiments, the body comprises a roller base in order to transfer the support board between multiple beds. In some embodiments, the apparatus comprises a torsion spring that is loaded when the body is tilted downward and released as the body is separately tilted upwards from the lying position. In some of these embodiments, the torsion spring comprises a release mechanism which releases the torsion spring in order to urge the apparatus upwards to the sitting position.

DETAILED DESCRIPTION OF THE INVENTION

Embodiments of the present application are directed to a method and apparatus for assisting persons from a lying position to a sitting position comprises a mechanical support support board for supporting a body of the person while lying in bed. An extension of the support board reaches away from the bed to accommodate the legs and thighs of the person. The support board is pivoted and tilted upwards in order to move the person from a lying position to an upright and sitting position. The support board assists caregivers with lifting a patient into and out of bed while minimizing both risk of injury to the caregiver and physical and/or emotional discomfort to the patient.

Reference will now be made in detail to implementations of a support board for moving a person from a lying position to a sitting position as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
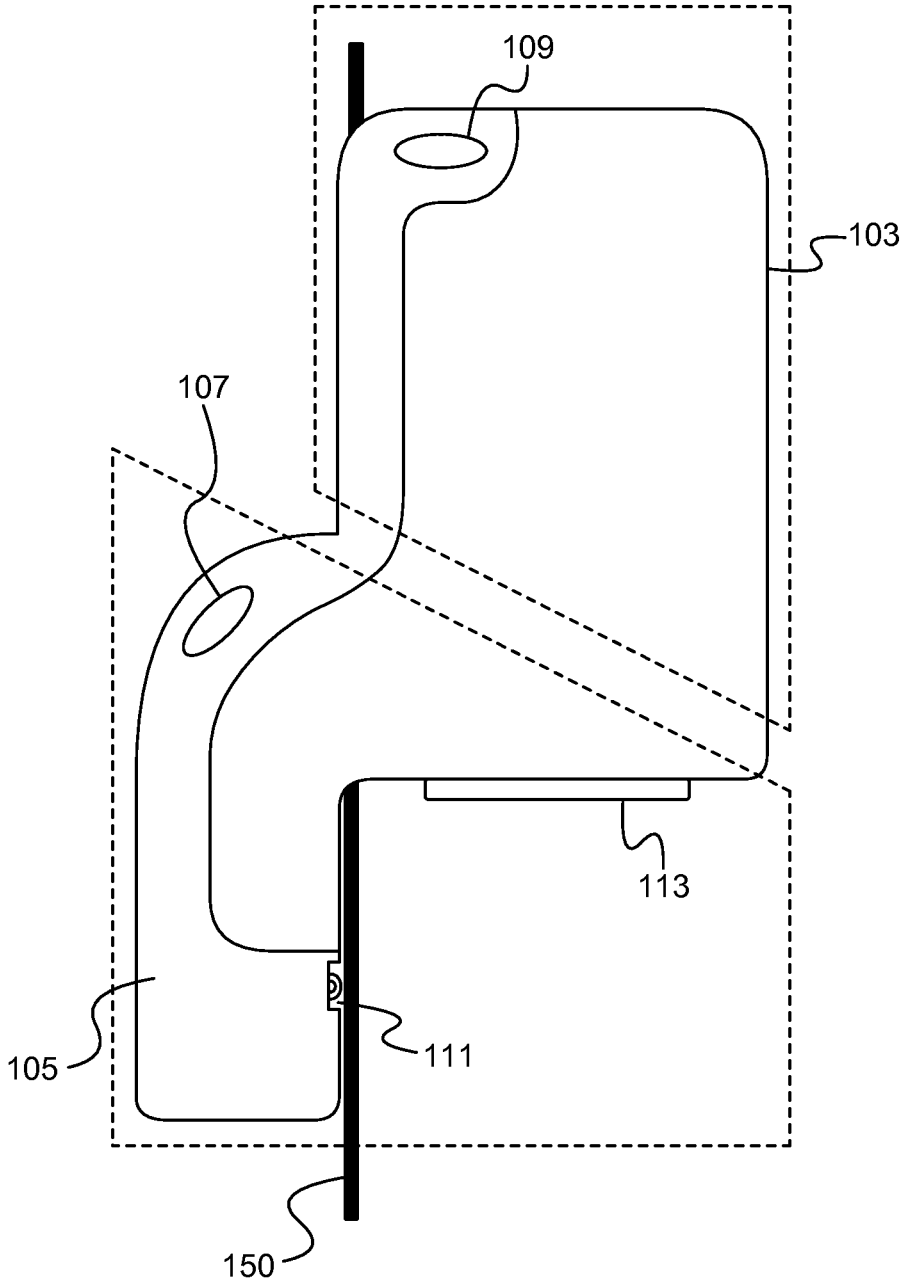
FIG. 1 illustrates a top down view of a support board for moving a person from a supine position to a sitting position in accordance with some embodiments.

Referring now to FIG. 1, a support board for moving a person from a lying position to a sitting position is depicted therein. The support board 100 comprises a board body 100 comprising an upper section 103 and a lower section 105. As shown within FIG. 1, the line 150 represents an edge of a bed. When the support board 100 is placed on the bed, the upper section 103 lies to the left of the line 150 on the bed and the lower body lies to the right of the line 150 and extends off of the bed. The upper section 103 is configured to support the upper body of a person and the lower section 105 is configured to support the lower body of a person. With a person lying on the bed and in the lying position, the support board 100 is slid under the person, and the person rolls to a side-lying position so that the person's upper body is on the upper section 103 and the person's legs are supported by the lower section 105. The board 100 is then tilted upwards and the person is raised from the lying position and to the sitting position. It will be understood that the board 100 can be used to assist a patient from either side of the bed. When assisting a patient from the other side of the bed the words left and right will be substituted for one another.

The upper section 103 is configured to extend back and onto the bed in order to balance the support board 100 without the need of person's body weight. The lower section 105 is configured to help roll the person from the lying position using the person's own weight. As shown within FIG. 1, in some embodiments, the support board 100 comprises one or more handles 107 and 109. The handle 107 is configured to help maintain the balance of a caregiver or other person assisting in moving the person from the lying position to the sitting position. The handle 107 can also be used to facilitate greater leverage on the device. The handle 109 is placed at a top of the support board 100 in order to reduce back pain as the person is lifted from the lying position to the sitting position. A marker 113 is used in order to inform the person and/or the helper where the person to be raised or lowered should be placed on the board 100. Particularly, the person's hip should line up with the marker 113 for maximum leverage when using the support board 100. In some embodiments, the marker comprises a small piece of material such as wood, plastic or other rigid material.

As further shown within FIG. 1, in some embodiments, a bracket 111 is used as an anchor for a foot pedal that can be used to obtain greater leverage when tilting the support board 100. In some embodiments, the bracket 111 is indented so that it does not contact and cause harm to the person. Additionally, in some embodiments, the corners of the support board 100 are rounded in order to avoid harm to a person when the support board 100 is put onto the bed adjacent to the patient.

The support board 100 is preferably formed of a composite board such as plywood. Alternatively, it can be formed of wood, press board, injection molded plastic, formed plastic, sheet metal, or sheet metal coupled to a rigid frame. For aesthetics, the support board 100 can be painted or upholstered. For comfort, the support board can be upholstered, padded, shaped to better fit a person's body or any combination thereof. To accommodate a caregiver assisting a person from wither side of the bed, preferably both sides of the support board 100 are mirror images of each other. Alternatively, there can be a left-side support board and a right-side support board.

Figure 2:
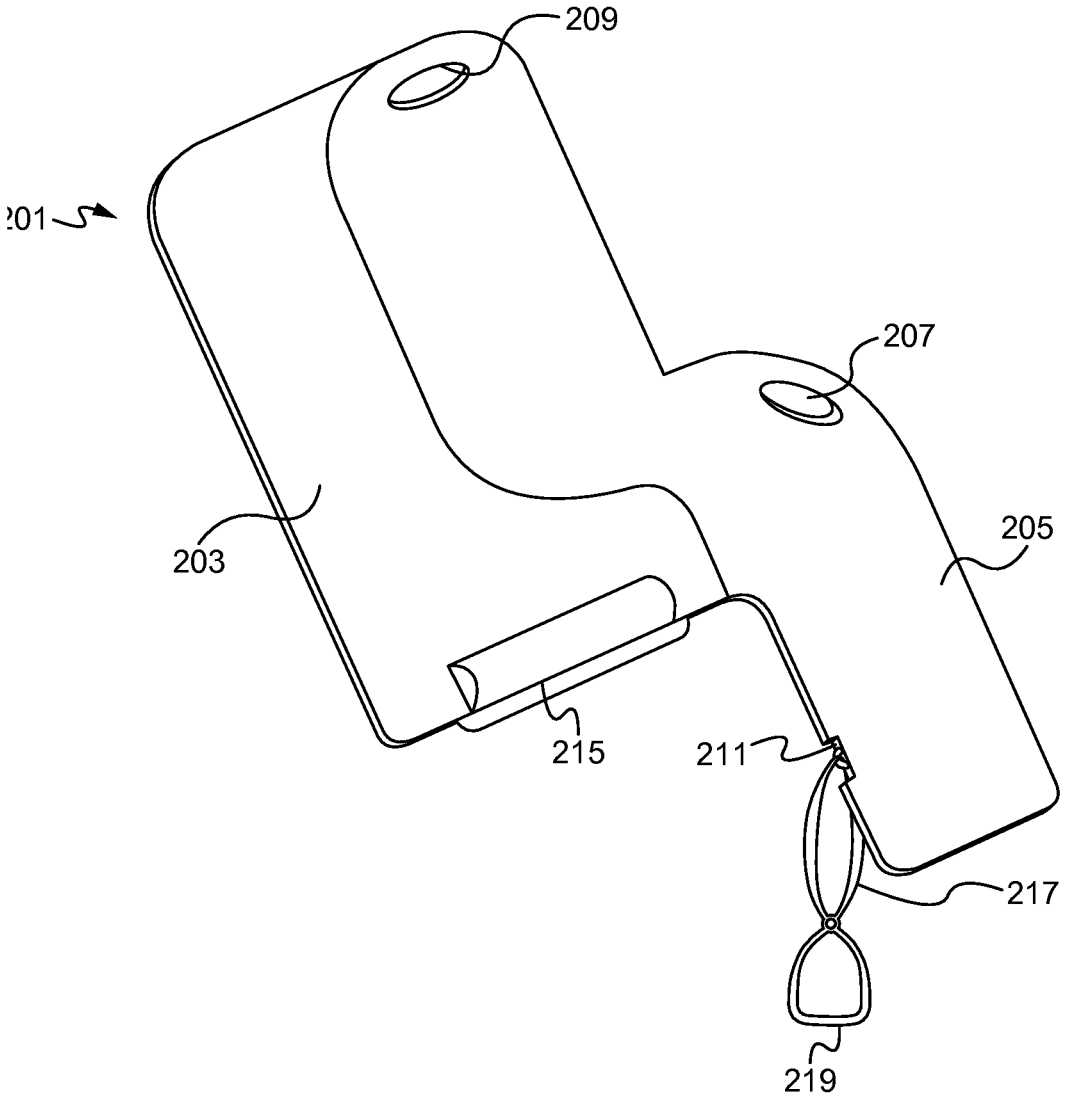
FIG. 2 illustrates a bottom perspective view of a support board for moving a person from a supine position to a sitting position in accordance with some embodiments.

FIG. 2 illustrates a bottom perspective view of a support board for moving a person from a lying position to a sitting position in accordance with some embodiments. The support board 200 is similar to the support board 100, such as described above. The support board 200 comprises a board body 201 comprising an upper section 201, a lower section and one or more handles 207 and 209. As shown within FIG. 2, a leg support 217 is coupled to the board through the bracket 211. In some embodiments, the leg support 217 comprises an elastic band or coiled spring which is coupled to a foothold 219 which enables a caregiver or other person assisting a person moving a person from a lying position to a sitting position to place their foot within the foothold 219 in order to provide greater leverage when tilting the board. As further shown within FIG. 2, the support board 200 comprises a rounded section 215 or roller that can act as a fulcrum when tilting the support board 200. In some embodiments, the rounded section 215 comprises a foam or other semi-rigid material.

Figure 3A:
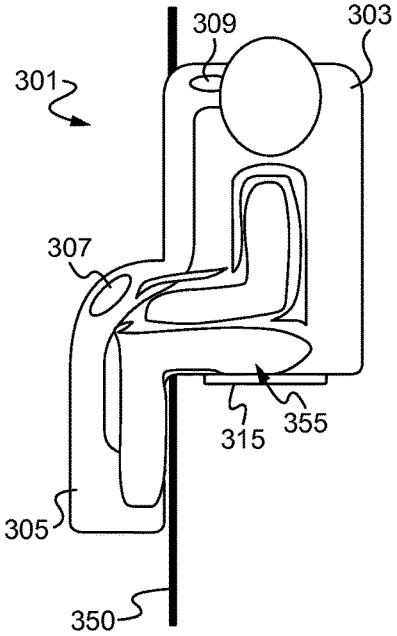
FIG. 3A illustrates a top down view of a support board for moving a person from a supine position to a sitting position before lift in accordance with some embodiments.
Figure 3B:
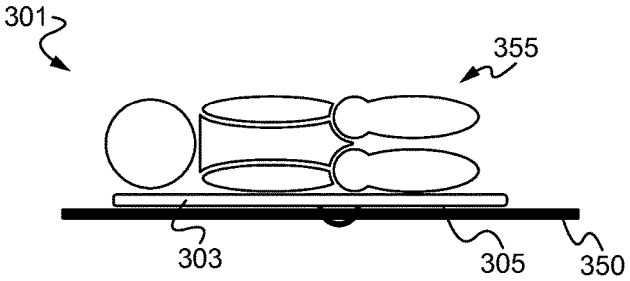
FIG. 3B illustrates a side view of a support board for moving a person from a supine position to a sitting position before lift in accordance with some embodiments.
Figure 3C:
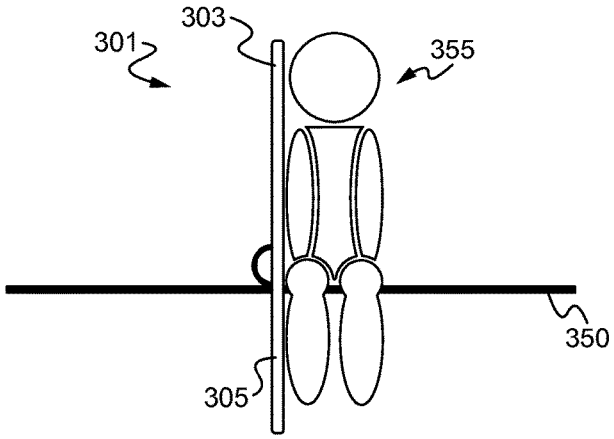
FIG. 3C illustrates a side view of a support board for moving a person from a supine position to a sitting position after lift in accordance with some embodiments.

FIGS. 3A through 3C illustrate a support board for moving a person from a lying position to a sitting position before lift in accordance with some embodiments. As shown within FIG. 3A, the person to be assisted 355 is lying on their back on a bed. The body 301 of the support board is placed onto the bed adjacent to the person. The person 355 rolls or is helped onto the support board such that their torso in on an upper section 303 of the board and their legs are supported by a lower section 305 of the board. As described above, in some embodiments, the body 301 comprises rounded corners to avoid injuring the person 355 or the caregiver. When the support board body 301 is slid under the person 355, the top section 303 of the support board extends from the person's 355 shoulder down to their hips. Preferably, the person's hips 355 are aligned to the upper section 303 so that as the support board is tilted upward, the person's bottom rests comfortably on the bed. The bottom section 305 reaches away from the bed and support the legs and thighs of the person before they are lifted and/or tilted to the sitting position. As shown within FIG. 3A, the unique shape of the support board allows for the upper body of the person 355 in bed to be supported safely on the bed while in a side-lying.

FIG. 3B illustrates a side-view of the person to be assisted lying on the support board. As described above, and as indicated by the arrows, in some embodiments, one or more handles of the board body 301 are utilized to lift the support board and person up and to the sitting position. FIG. 3C illustrates the assisted person in the upright and sitting position, after being lifted. As shown within the figures, the lower legs and the thighs of the person are supported by the lower section 305 that cantilevers off and from the edge 350 of the bed so that the mass of the lower half of the person to be assisted counterbalances the mass of the upper body and thus can be used to assist tipping the device to an upright and sitting posture. As described above, the body 301 can optionally include a rounded rocker 315 that takes advantage of the rounded shape to assist in leveraging the assisted person to the upright position.

Figure 4A:
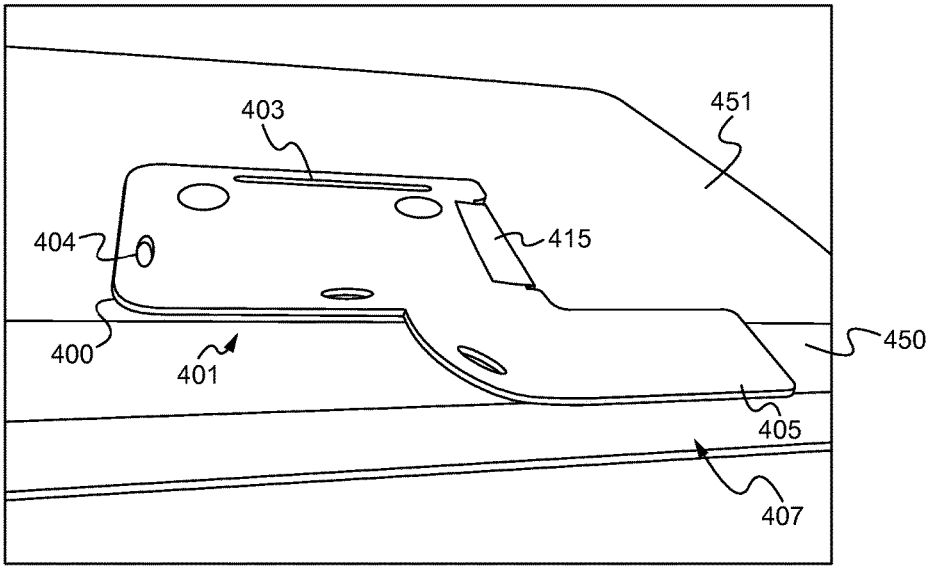
FIGS. 4A-4E illustrate a person using a support board for moving a person from a supine position to a sitting position in accordance with some embodiments.

FIG. 4A illustrates the unique shape of the support board 400 as it is lying on a bed 451. As described above, the body 401 of the support board 400 replicates a side-lying person's body alignment. The top section 403 of the support board extends from the person's 455 shoulder down to their hips. The bottom section 405 reaches away from the bed and support the legs and thighs of the person before they are lifted and/or tilted to the sitting position. The one or more handles 407 and 409 enable the caregiver or aide to easily lift and rotate the board 400 to a sitting position and the roller 415 is rounded on the underside of the board to allow a rocker for easy weight transfer.

Figure 4B:
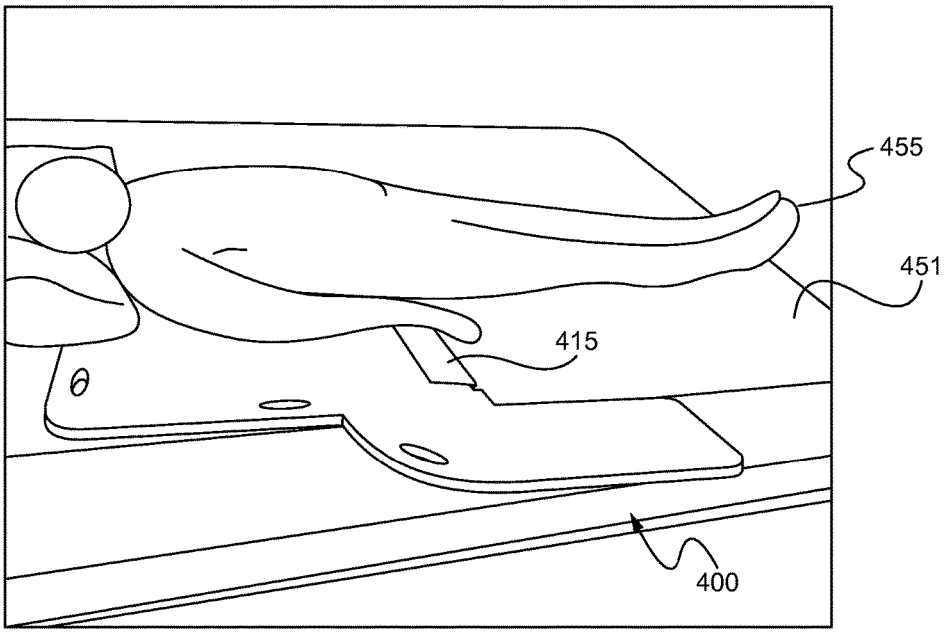

As shown in FIG. 4B, the person 455 is lying on the bed 451 and the board 400 is adjacent the person 455 and tucked under their elbow. As described above, in some embodiments, the board 401 comprises one or more rounded corners in order to easily slide under the person 455. The roller board 415 is aligned so that is relatively even with the hip or greater trochanter area of the person 455.

Figure 4C:
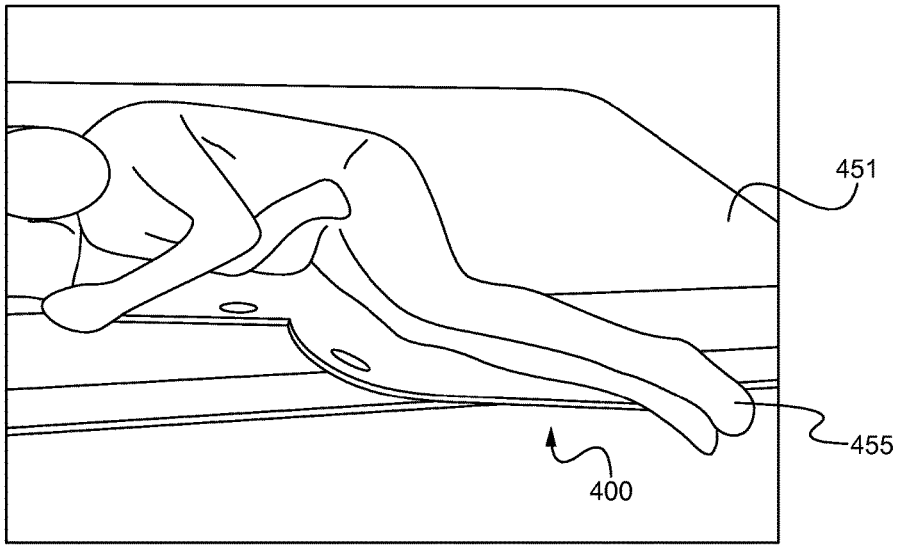
Figure 4D:
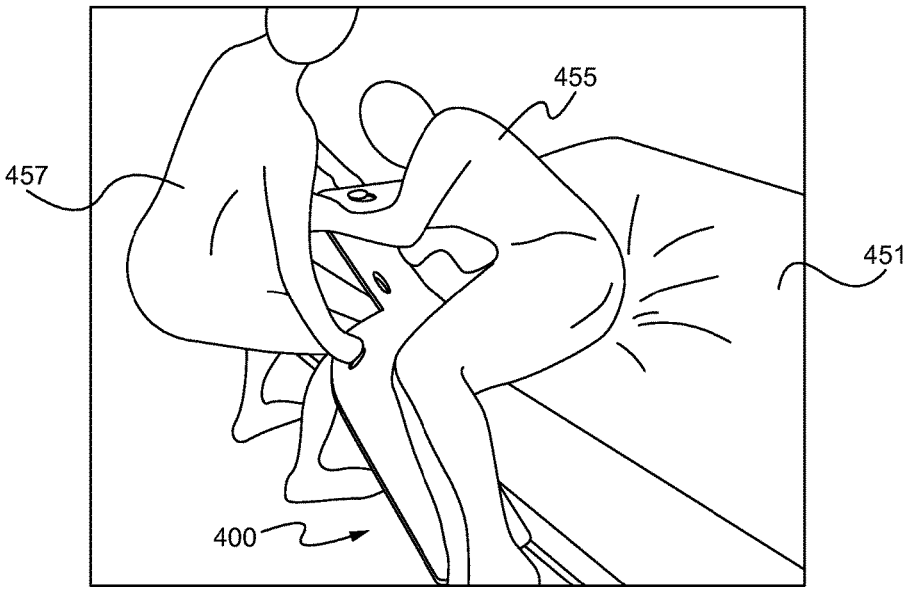
Figure 4E:
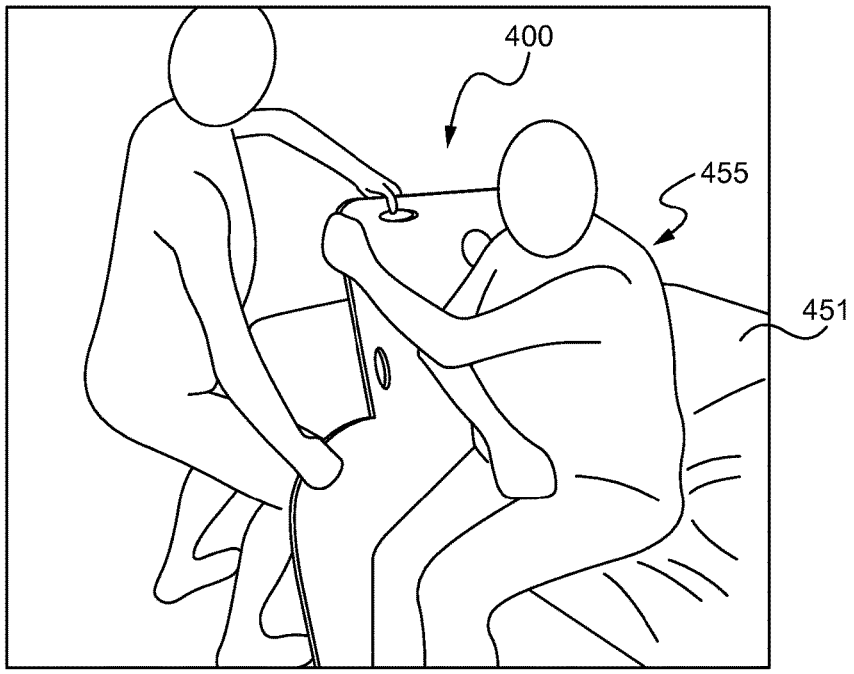

Then, as shown as shown in FIG. 4C, the person rolls onto their side onto the support board with their legs cantilevered off of the edge of the bed and supported by the lower section of the board. The weight of the persons legs provides additional mechanical advantage as a counterweight to the person's upper body, reducing the amount of force required to move the person to the sitting position. As shown within FIG. 4D, with improved body mechanics, a caregiver can use the mechanical advantage of the board and lift with less stress on the caregiver's body. FIG. 4E shows that the person receiving assistance has reached the sitting position comfortably and with reduced stress to his or her body and emotions due to the support of the board.

Figure 5:
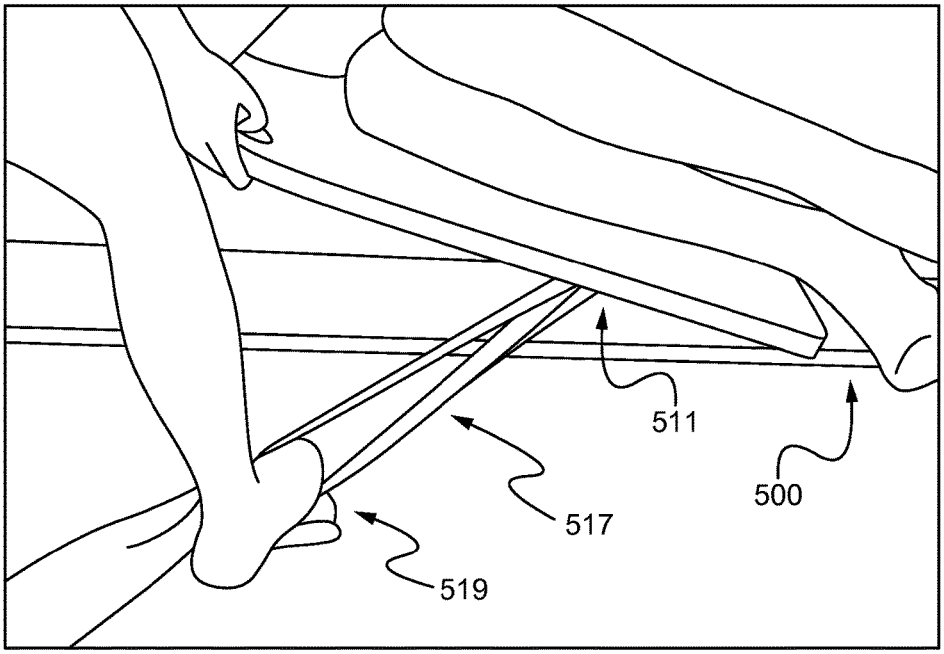
FIG. 5 illustrates an assisting mechanism coupled to a support board for moving a person from a supine position to a sitting position in accordance with some embodiments.

As described above, and as shown in FIG. 5, a leg support 517 is coupled to the board through the bracket 511. In some embodiments, the leg support 517 comprises an elastic band or coiled spring which is coupled to a foothold 519 which enables a caregiver or other person assisting a person moving a person from a lying position to a sitting position to place their foot within the foothold 519 in order to provide greater leverage when tilting the board.

Figure 6:
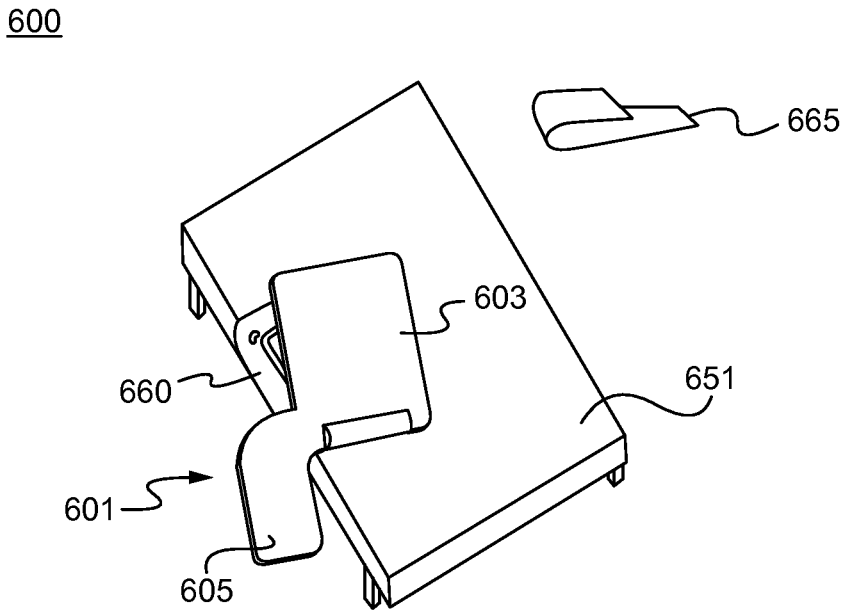
FIG. 6 illustrates a support board for moving a person from a supine position to a sitting position in accordance with some embodiments.

In some embodiments, the support board comprises a torsion spring which takes the place of a caregiver. FIG. 6 illustrates a support board for moving a person from a lying position to a sitting position in accordance with some embodiments. FIG. 6 illustrates a support board for moving a person from a lying position to a sitting position in accordance with some embodiments. The support board 600 comprises a board body 601 comprising an upper section 603 and a lower section 605.

As a person begins getting into bed 651, the support board 600 is at a slightly raised angled position such that the spring 660 is in an unloaded and an extended position. As the person puts weight on the support board 600 and begins to move toward a side lying position, the torsion spring 660 is loaded and offers a controlled movement to the side lying position. The spring 660 is loaded and the person rolls onto their back and in some embodiments, can fold the support board 600 against the bed 651 so that it does not occupy sleeping space on the bed 651. As the person wishes to get out of bed, the person lowers the support board 600 back onto the bed 651, rolls onto their side so that they occupy the support board, such as described above, and press the release lever 665. The release lever 665, releases the loaded torsion spring 660 which lifts the support board 600 and moves the person to a sitting position.

Figure 7A:
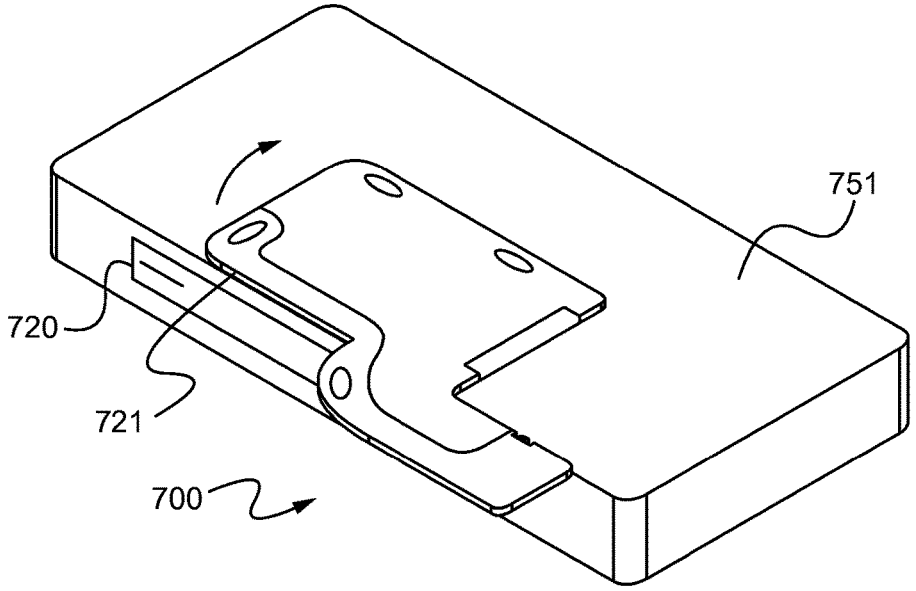
FIGS. 7A and 7B illustrate a support board and two-axis hinge for moving a person from a supine position to a sitting position in accordance with some embodiments.
Figure 7B:
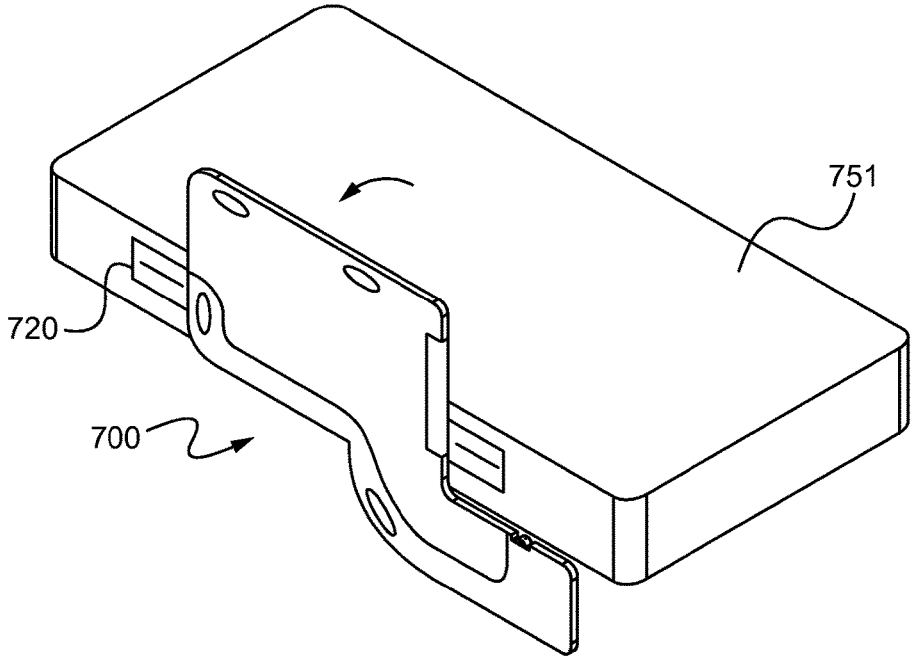

In some embodiments, the support board 700 is configured to universally clamp to a frame of the bed 751. FIGS. 7A and 7B illustrate a support board and two-axis hinge for moving a person from a supine position to a sitting position in accordance with some embodiments. For such embodiments, a two axis hinge 720 is mounted to an edge of the bed 751. As shown in FIG. 7A, a first axis of the hinge 720 rotates in a manner to assist the person in sitting up or lying down. Additionally, as shown in FIG. 7B, a second axis of the hinge 720 allows the board to rotate up to essentially form a side rail to the bed 751. The two axis hinge 720 can be mounted to a side rail of the bed such as a hospital bed or to an L-shaped element fitted under the mattress for support.

Figure 8:
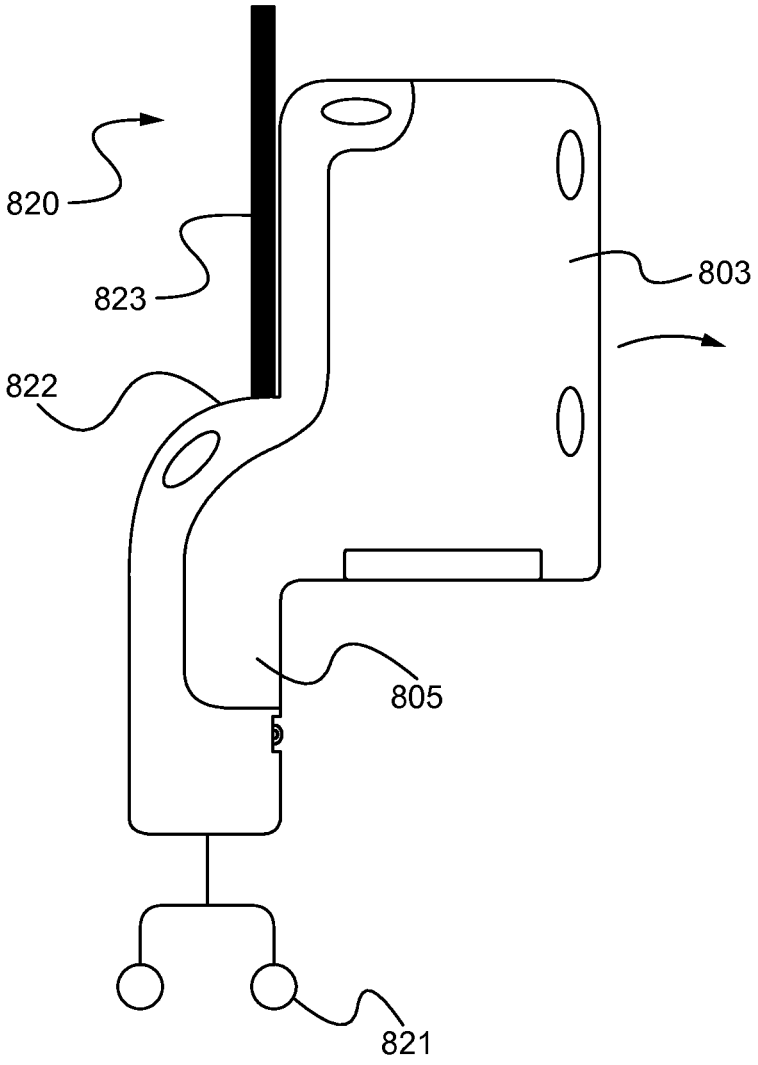
FIG. 8 illustrates a support board for moving a person from a supine position to a sitting position in accordance with some embodiments.

In some embodiments, as shown in FIG. 8, a support board is coupled to a roller base. The support board 800, is similar to the support boards such as described above and comprises a board body 801 comprising an upper section 803 and a lower section 805. The support board 800 is coupled to a rolling base 820 with one or more locking wheels 821. As shown by the arrow, the board 800 is rotatably mounted to the rolling base 820 at a pivot point 822. The support board 800 pivots from the stored location where it can be slid onto a bed and used by a caregiver in order to raise and lower the patient from the sitting and lying position. The roller base 820 enables the support board 800 to be used by multiple different persons in a location, such as care facility, hospital or other location where there are multiple persons in need of assistance. The vertical shaft 823 of the rolling base 820 can adjust in height to accommodate beds of different height.

Figure 9:
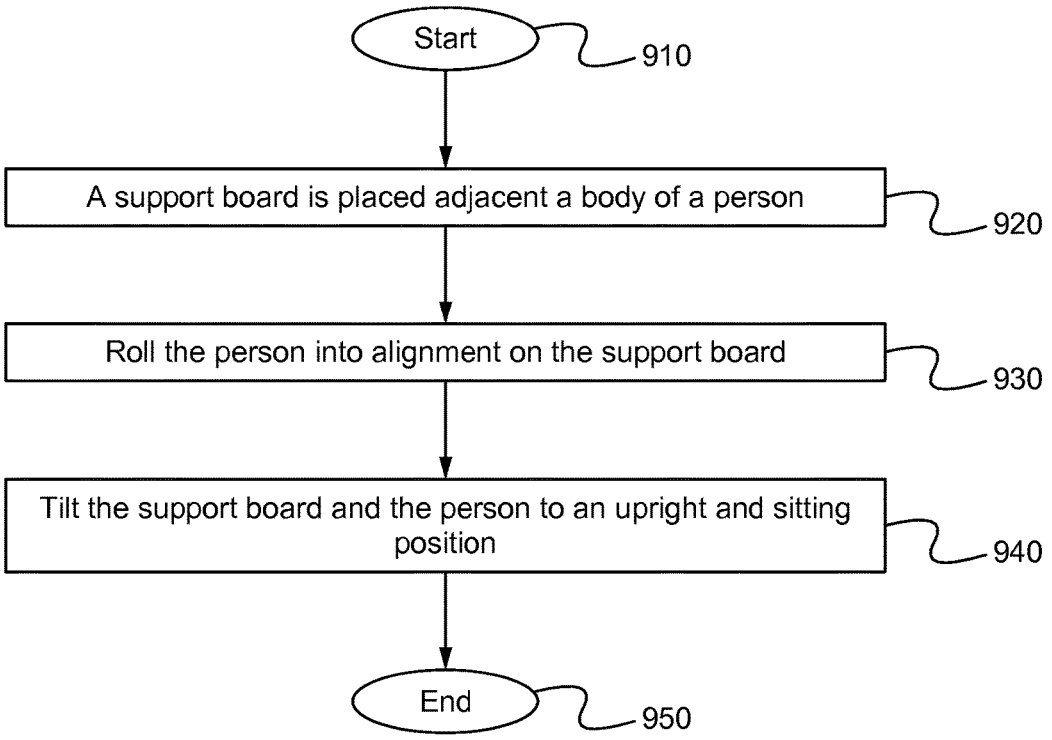
FIG. 9 illustrates a method assisting a person moving from a supine position to a sitting position

FIG. 9 illustrates a method assisting a person moving from a lying position to a sitting position. The method begins in the step 910. In the step 920, a support board is placed adjacent a body of the person being moved from a lying position to a sitting position. In the step 930, the person is rolled into alignment on the support board. For example, as described above, the support board is aligned such that a top section of the support board extends from the person's shoulder down to their hips. The bottom section reaches away from the bed and support the legs and thighs of the person before they are lifted and/or tilted to the sitting position. Then, in the step 940, the support board is tilted so that the person is moved from a side-lying position to an upright and sitting position.

In operation, the support board uses a simply designed support board and method which enables a person to roll onto their side and onto a contoured support board which extends from the person's shoulder down to the thighs. When the support board is placed on a bed, an extension of the support board cantilevers away from the bed to accommodate the thighs of the person as a caregiver shifts them forward in preparation for lifting the patient to the sitting position. Particularly, the unique shape of the board allows for the upper body of the person in bed to be supported safely on the bed while in a side-lying position. The lower legs of the person are supported on the section of the device that hangs specifically off of the bed so that the weight of the lower half of the person to be assisted can be used to aid in tipping the device to an upright sitting posture. In addition, in some embodiments, the device includes a rounded rocker that takes advantage of the device's shape in order to further assist in leveraging the assisted person to the upright position. Further, in some embodiments, an attached lever and torsion spring further assists moving the person to a sitting position, with a simple release of the lever.

This levered lifting maneuver not only reduces stress to the caregiver, it also reduces the emotional and physical stress to the person being lifted. Specifically, the device and method allows a caregiver to use the mechanical advantage of the board to lift a person to a seated position with improved body mechanics for the caregiver and support for this person being assisted. As such, the method and apparatus for assisting persons from a lying position to a sitting position as described herein has many advantages.

I claim:

1. An apparatus for supporting a person into and out of bed, the apparatus comprising:

a. a substantially planar body comprising:

i. an upper section configured to support an upper body of the person and;

ii. a lower section configured to support a lower body of the person, wherein the lower section is offset from a side of the upper section so that when the upper section is aliened with an outer edge of a bed, the lower section is suspended off of the bed, wherein when the body is positioned on a bed under a person the lower section is off of the bed and supports the person's legs, and wherein the body is tilted downward to support a person from a sitting position to a lying position and into bed and the body is separately tilted upwards to support a person from a lying position to a sitting position and out of bed.

2. The apparatus of claim 1, wherein the body comprises one or more handles.

3. The apparatus of claim 1, wherein the body is configured to balance on the bed without the person's body weight.

4. The apparatus of claim 1, wherein the body comprises a rounded section which acts as a fulcrum when the body and the person are tilted to the sitting position.

5. The apparatus of claim 1, comprising a foothold for providing greater leverage when tilting the body.

6. The apparatus of claim 1, wherein the body removably couples to the bed.

7. The apparatus of claim 1, wherein the body comprises a roller base in order to transfer the apparatus between multiple beds.

8. The apparatus of claim 1, wherein the apparatus comprises a torsion spring that is loaded when the body is tilted downward and released as the body is separately tilted upwards from the lying position.

9. The apparatus of claim 8, wherein the torsion spring comprises a release mechanism which releases the torsion spring in order to urge the apparatus upwards to the sitting position.

* * * * *